US006346781B1

(12) United States Patent
Mosebrook et al.

(10) Patent No.: US 6,346,781 B1
(45) Date of Patent: Feb. 12, 2002

(54) SIGNAL GENERATOR AND CONTROL UNIT FOR SENSING SIGNALS OF SIGNAL GENERATOR

(75) Inventors: Donald R. Mosebrook, Coopersburg; Lawrence R. Carmen, Jr., Hellertown, both of PA (US)

(73) Assignee: Lutron Electronics Co., Inc., PA (US)

( * ) Notice: Subject to any disclaimer, the term of this patent is extended or adjusted under 35 U.S.C. 154(b) by 0 days.

(21) Appl. No.: 09/873,749

(22) Filed: Jun. 4, 2001

Related U.S. Application Data

(62) Division of application No. 09/400,928, filed on Sep. 22, 1999.

(51) Int. Cl.[7] ..... G05F 1/00

(52) U.S. Cl. ..... 315/294; 315/292; 315/297; 315/291; 315/320

(58) Field of Search ..... 315/294, 297, 315/292, 320, 291, 307, 322, 315, 149, DIG. 4

(56) References Cited

U.S. PATENT DOCUMENTS

| | | | | |
|---|---|---|---|---|
| 4,489,263 | A | 12/1984 | Potter et al. | 318/727 |
| 4,714,862 | A | 12/1987 | Dannert et al. | 315/244 |
| 4,721,953 | A | 1/1988 | dePauw | 340/825.17 |
| 4,746,809 | A | 5/1988 | Coleman et al. | 307/1 |
| 4,751,433 | A | 6/1988 | Baccanelli | 315/158 |
| RE33,504 | E | 12/1990 | Yuhasz et al. | 307/45 |
| 5,017,837 | A | 5/1991 | Hanna et al. | 315/136 |
| 5,144,205 | A | 9/1992 | Motto et al. | 315/244 |
| 5,248,919 | A | 9/1993 | Hanna et al. | 315/291 |
| 5,519,263 | A | 5/1996 | Santana, Jr. | 307/115 |
| 5,541,584 | A | 7/1996 | Mehta et al. | 340/825.57 |
| 5,619,081 | A | 4/1997 | Gershen et al. | 307/125 |
| 5,731,664 | A | 3/1998 | Posa | 315/194 |
| 5,798,581 | A | 8/1998 | Keagy et al. | 307/118 |
| 5,861,720 | A | 1/1999 | Johnson | 315/291 |
| 6,169,377 | B1 * | 1/2001 | Bryde et al. | 315/294 |

FOREIGN PATENT DOCUMENTS

| | | |
|---|---|---|
| EP | 0786850 | 7/1997 |

* cited by examiner

*Primary Examiner*—Don Wong
*Assistant Examiner*—Tuyet T. Vo
(74) *Attorney, Agent, or Firm*—Ostrolenk, Faber, Gerb & Soffen, LLP

(57) ABSTRACT

A signal generating circuit coupled to an AC supply, the circuit comprising at least one first switch device coupled to the AC supply, at least one triggerable switch device coupled to the first switch device, operation of the first switch device causing said triggerable switch device to trigger in response to the AC supply at a predetermined voltage, thereby providing at least a portion of a waveform of the AC supply as a control signal and wherein the control signal terminates within a predetermined period of time after operation of the first switch device terminates. A circuit for detecting and responding to the signals generated by the signal generator is also disclosed.

31 Claims, 14 Drawing Sheets

SIGNAL GENERATOR AND CONTROL UNIT FOR SENSING SIGNALS OF SIGNAL GENERATOR

CROSS REFERENCE TO RELATED APPLICATION

This is a divisional of U.S. patent application Ser. No. 09/400,928, filed Sep. 22, 1999 in the names of Donald R. Mosebrook and Lawrence R. Carmen, Jr. and entitled "Signal Generator and Control Unit For Sensing Signals of Signal Generator."

FIELD OF THE INVENTION

The present invention relates generally to a signal generator capable of producing a plurality of control signals and a sensing circuit for detecting the control signals produced by the signal generator. Even more particularly, the invention relates to signal generators that can be produced at low cost.

BACKGROUND OF THE INVENTION

Remote signal generators capable of sending command signals are known. FIG. 1 shows an electric lamp wall box dimmer 12 coupled to a remote signal generator 10 through two conductors 14 and 16. A wallbox dimmer and remote signal generator are available from the assignee of the present application and known as the Maestro dimmer and accessory dimmer. The wall box dimmer comprises a signal detector 32 capable of receiving and decoding three discrete signals generated by the signal generator 10. The signals are generated when a user actuates momentary contact switches "T", "R" or "L". The "R" switch generates the signal shown in FIG. 2A when actuated which causes the dimmer to increase the light intensity of the coupled load 20. The "L" switch generates the signal shown in FIG. 2B when actuated which causes the dimmer to decrease the light intensity of the coupled load 20. The "T" switch generates the signal shown in FIG. 2C when actuated which causes the wall box dimmer 12 to turn on to a preset light intensity, go to full light intensity, fade off slowly or fade off quickly. Each time the switch "T" is actuated, the signal generated and sent to the signal decoder 32 is always the same. To cause the dimmer to react differently to the closure of switch "T", the user must actuate the "T" switch differently. When a user actuates switches "R", "L" or "T" the signal detector 32 actually receives a string of signals because the user is usually not capable of actuating and releasing the switches in less than one line cycle (16 mSec on a 60 Hz line). The signal is only generated as long as the switch is closed.

A microcomputer 28 in the wall box dimmer 12 is capable of determining the length of time the switch "T" has been actuated and if the switch "T" has been actuated and released a plurality of times in quick succession. The microcomputer is programmed to look for the presence or absence of an AC half cycle signal from the signal detector 32 a fixed period of time after each zero cross of the AC line, preferably 2 mSec. The microcomputer only looks once during each half cycle. The advantage of the signal generator of the prior art is its low cost. The drawback to this type of signal generator is that there are a limited number of signals that can be generated without requiring the user to actuate the same actuator repeatedly or actuate the actuator for an extended period of time in order to perform additional functions. Details of a signal generator according to the prior art are disclosed in issued U.S. Pat. No. 5,248,919, the entire disclosure of which is hereby incorporated by reference.

There is a need for a low cost signal generator that does not require the user to actuate the same actuator in different ways to initiate multiple functions.

Also known are phase control lamp dimmers which use a semiconductor device to control the phase of an AC waveform provided to an electric lamp thereby to control the intensity of the lamp. These phase control dimmers are not ordinarily considered to be signal generators of the type contemplated herein. Further, such phase control dimmers, until turned off, produce a phase shaped AC waveform continuously unlike the signal generator described above in connection with FIG. 1.

Other signal generators of the prior art can generate a plurality of control signals, but require a microprocessor in the signal generator which converts the actuator actuations into digital signals for processing by another microprocessor. The drawback to this type of signal generator is the added cost of the microprocessor and its associated power supply.

Accordingly, there is a need for a low cost signal generator that overcomes the drawbacks of the prior art.

SUMMARY OF THE INVENTION

It is an object of the present invention to provide a signal generator which is capable of producing a plurality of different control signals.

Yet still a further object of the present invention is to provide a signal generator which can be manufactured at low cost.

It is yet still a further object of the present invention is to provide a signal generator which produces unique control signals based upon portions of alternating current waveforms.

Yet still a further object of the present invention is to provide a sensing circuit for detecting the control signals produced by the signal generator circuit according to the present invention.

Yet still a further object of the present invention is to provide a signal generator which requires only two wires for connection to a sensing circuit.

The above and other objects are achieved by a signal generator comprising a switch in series with at least one of a zener diode and a diac, the signal generator producing an output when the switch is actuated, the output having a region where the current is substantially constant.

The above and other objects are also achieved by a signal generator comprising at least one of a zener diode and a diac, the signal generator producing an output when a switch in series with the at least one of a zener diode and diac is actuated, the output having a region where the current is substantially constant.

The above and other objects are also achieved by a signal detector circuit coupleable to an AC source comprising a sense circuit, and a control circuit, the control circuit producing a signal when the sense circuit receives an AC signal having a region where the current is substantially constant.

The above and other objects are also achieved by a signal generating circuit coupled to an AC supply, the circuit comprising at least one first switch device coupled to the AC supply, at least one triggerable switch device coupled to the first switch device; operation of the first switch device causing said triggerable switch device to trigger in response to the AC supply at a predetermined voltage, thereby providing at least a portion of a waveform of the AC supply as a control signal and wherein the control signal terminates within a predetermined period of time after operation of the first switch device terminates. The triggerable switch device can be a zener diode, a diac or may be a semiconductor switching device having a control electrode, e.g., a triac, SCR or transistor, or an opto coupled version of such switching devices.

The above and other objects are also achieved by a circuit for sensing one of a voltage and current from a signal generator circuit producing a plurality of unique control signals based on an AC supply voltage, the sensing circuit comprising a detector detecting one of a voltage level and current level in a line coupling the sensing circuit and the signal generator and producing a sensed signal; a controller for causing said detector to detect one of the voltage level and current level at a plurality of times in a half cycle of the AC supply voltage; the controller providing a control signal based on the sensed signal.

BRIEF DESCRIPTION OF THE DRAWINGS

The foregoing summary, as well as the following detailed description of the preferred embodiments is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed. In the drawings.

DETAILED DESCRIPTION OF THE PREFERRED EMBODIMENT

Figure 3:
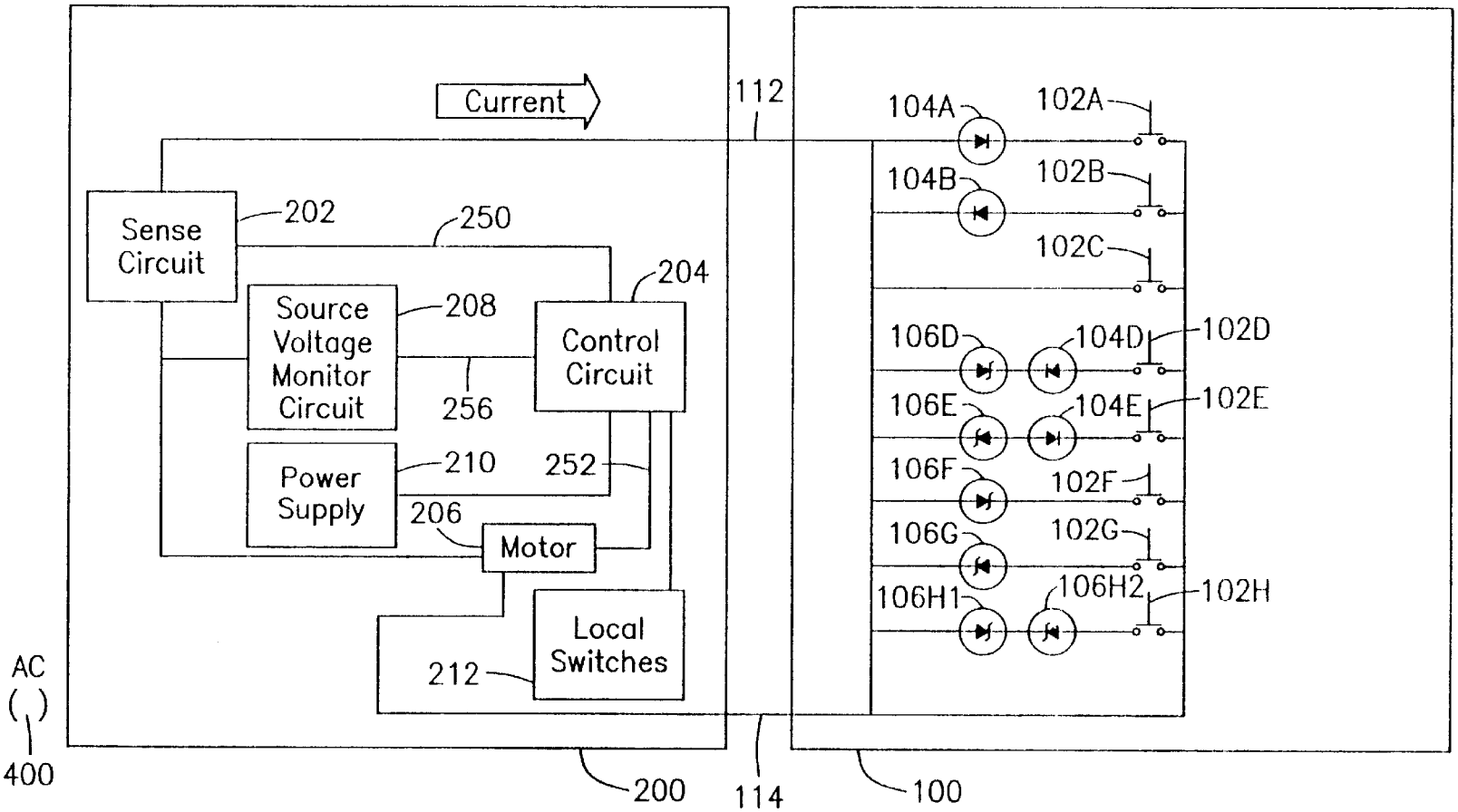
FIG. 3. is a simplified schematic diagram of a first embodiment of a signal generator and a block diagram of a signal decoder according to the present invention.

With reference again to the drawings, FIG. 3 shows a remote signal generator 100 coupled to a control unit 200 with conductors 112 and 114. The control unit 200 may be, as shown, a motorized window shade motor unit that controls a coupled window shade. However, the control unit 200 may be a control unit controlling other electrical devices, as desired. The control unit 200 is provided AC power (24 V AC) from a transformer 400.

The remote signal generator 100 comprises a plurality of momentary switches 102A–102H. A signal is provided to the control unit 200 only when one or more of the switches 102A–102H has been actuated. Each switch can be a momentary contact mechanical switch, touch switch, or any another suitable switch. For example, the switches may be tactile feedback or capacitance touch switches. The switches could also be semiconductor switches, e.g., transistors, themselves controlled by a control signal. In series with switch 102A is a diode 104A with the anode coupled to the sense circuit 202 and the cathode coupled to the switch. In series with switch 102B is a diode 104B with the cathode coupled to the sense circuit 202 and the anode coupled to the switch. There are no diodes in series with switch 102C. In series with switch 102D is a diode 104D with the anode coupled to the switch and a zener diode 106D with the anode coupled to the sense circuit 202. In series with switch 102E is a diode 104E with the cathode coupled to the switch and a zener diode 106E with the cathode coupled to the sense circuit 202. In series with switch 102F is a zener diode 106F with the anode coupled to the sense circuit 202 and the cathode coupled to the switch. In series with switch 102G is a zener diode 106G with the cathode coupled to the sense circuit 202 and the anode coupled to the switch. In series with switch 102H are two zener diodes 106H1 and 106H2 with the anode of zener diode 106H1 coupled to the sense circuit 202 and the anode of zener diode 106H2 coupled to the switch. In the preferred embodiment, diodes 104A, 104B, 104D, and 104E are type IN914 and zener diodes 106D, 106E, 106F, 106G, and 106H1 and 106H2 are type MLL961B with a break over voltage of 10 V.

Alternatively zener diodes 106D, 106E, 106F, 106G, 106H1 and 106H2 can be replaced with suitable value diacs in order to practice the present invention.

The control unit 200 comprises a sense circuit 202, a control circuit 204 controlling, e.g., a motor 206, a source voltage monitor circuit 208, a power supply 210, and optional local switches 212 provided for control functions, such as the same control functions controlled by the signal generator 100 and/or additional functions. The sense circuit 202 senses the current flowing between the AC source 400 and the signal generator 100.

The sense circuit 202 senses the direction of this current, i.e., whether a forward current, reverse current or substantially zero current. When current flows through the sense circuit 202, the sense circuit sends a signal to the control circuit 204 on line 250. In one embodiment, the sense circuit 202 senses the current. Alternatively, the sense circuit 202 could sense the voltage. The source voltage monitor 208 signals the control circuit 204 when the control circuit 204 should read the sense circuit. In the preferred embodiment, the source voltage monitor signals the control circuit 204 on line 256 to read the sense circuit twice during each half cycle. The sense circuit is first read before the transformer 400 voltage is high enough to turn on a zener diode in the signal generator 100. The sense circuit is then read after the transformer 400 voltage is high enough to turn on a zener diode in the signal generator 100. In this way, a determination can be made of the shape of the waveform from the signal generator circuit 100. In the preferred embodiment, the source voltage monitor signals the control circuit 204 to read the sense circuit at predefined times after each zero crossing, for example, two times after each zero crossing, when the AC supply is at 4.7 v and again when it reaches 18.0 v.

Based on this specification, circuits for implementing the techniques for detecting and processing the signals received from the signal generator 100 described herein can be readily constructed by those of skill in the art, and therefore, a detailed discussion of the circuitry of the control unit 200 is omitted.

In an embodiment controlling a motor, it is most preferred that the control circuit 204 includes a microprocessor operating under the control of a stored software program to produce output signals on line 252 to the motor 206 to cause it to rotate in a forward or reverse direction. In the preferred embodiment, the microprocessor is a Motorola MC68HC705C9A.

The control circuit 204 is powered from a suitable power supply 210 coupled to the AC source. The source voltage monitor circuit 208 provides a signal to the control circuit 204 concerning which half cycle (positive or negative) of the AC source is present at a particular time and a signal representative of the start of each half cycle.

Figure 1:
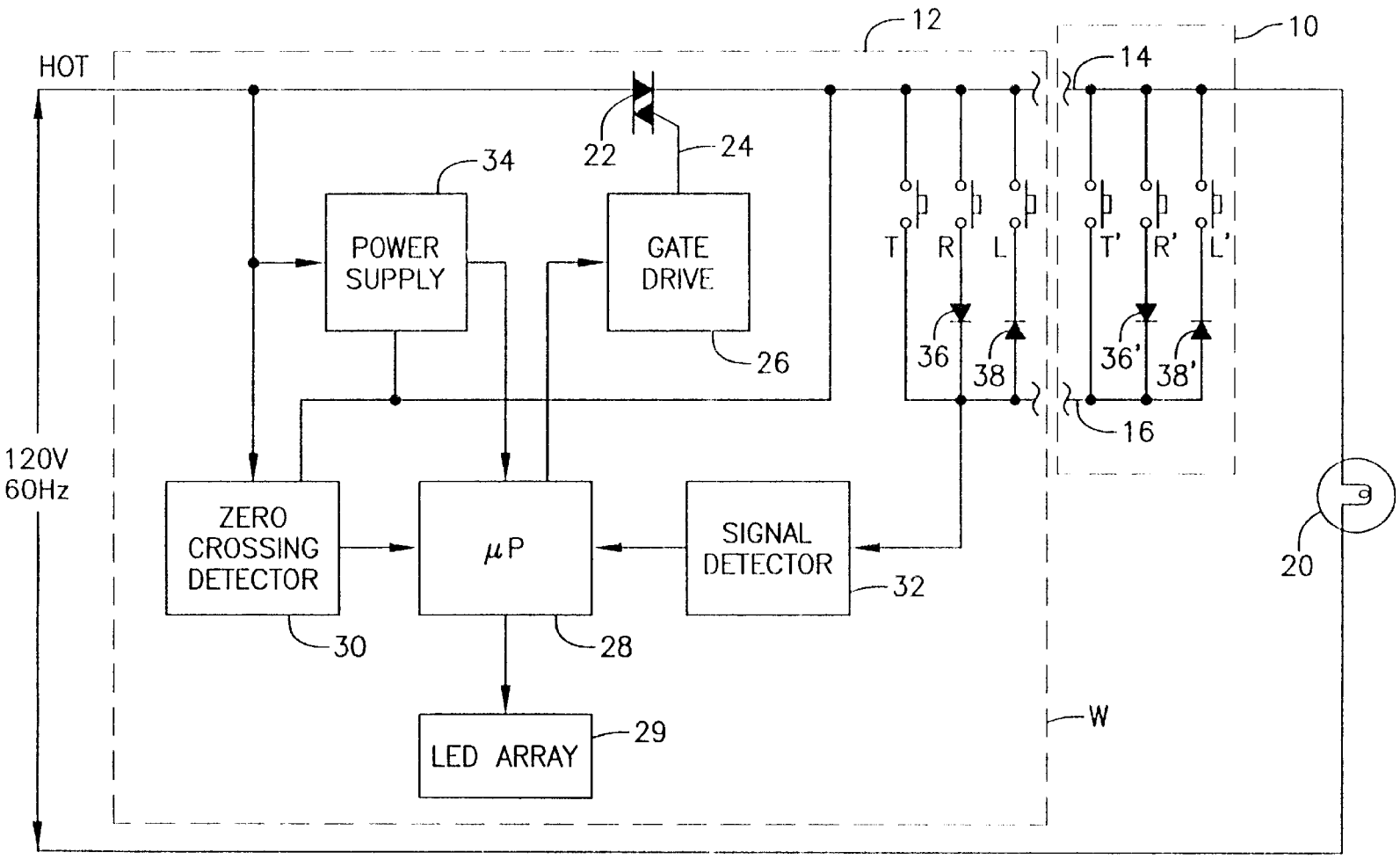
Fig. 1 PRIOR ART
FIG. 1. is a block diagram of a signal generator coupled to a wall box dimmer according to the prior art.
Figure 2A:
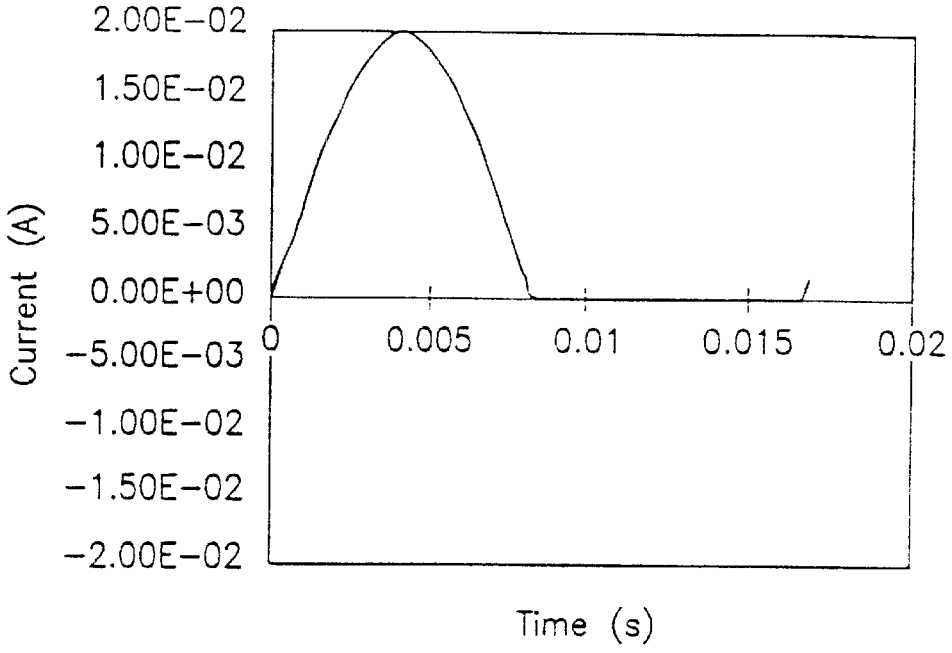
Fig. 2A PRIOR ART
FIGS. 2A, 2B, and 2C are plots of the outputs of the signal generator of FIG. 1.
Figure 2B:
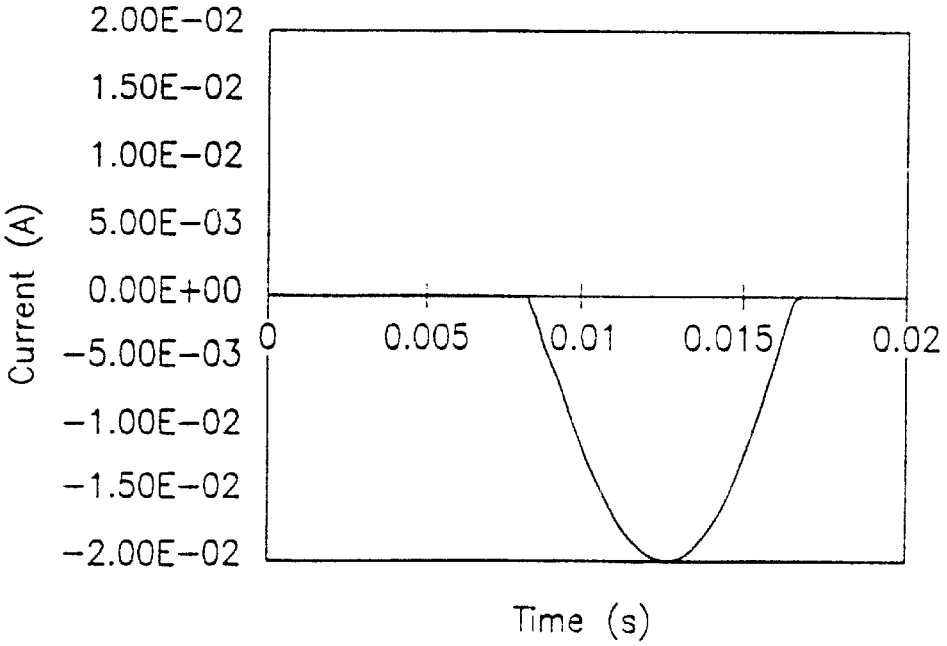
Fig. 2B PRIOR ART
Figure 2C:
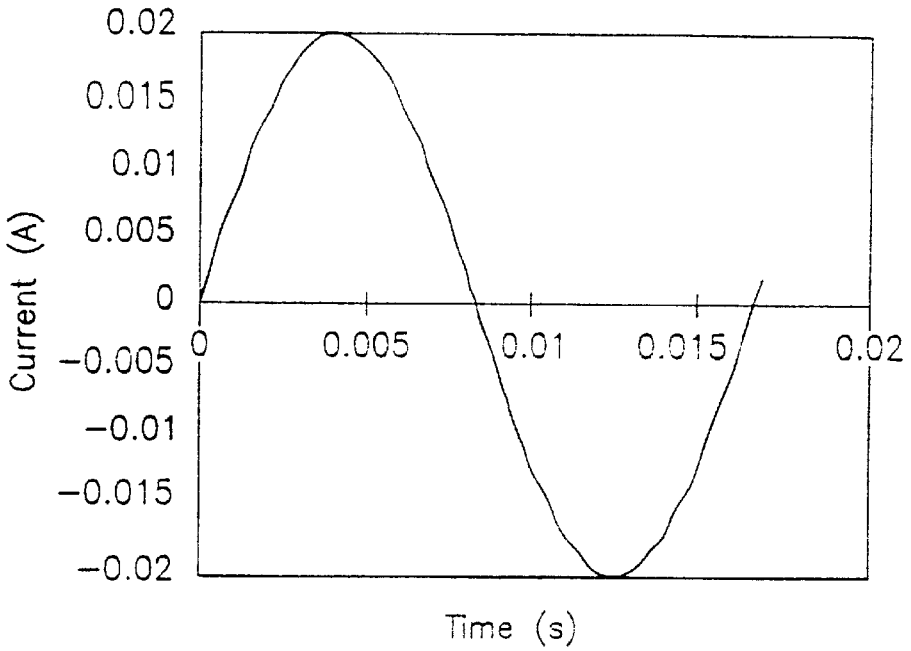
Fig. 2C PRIOR ART
Figure 4A:
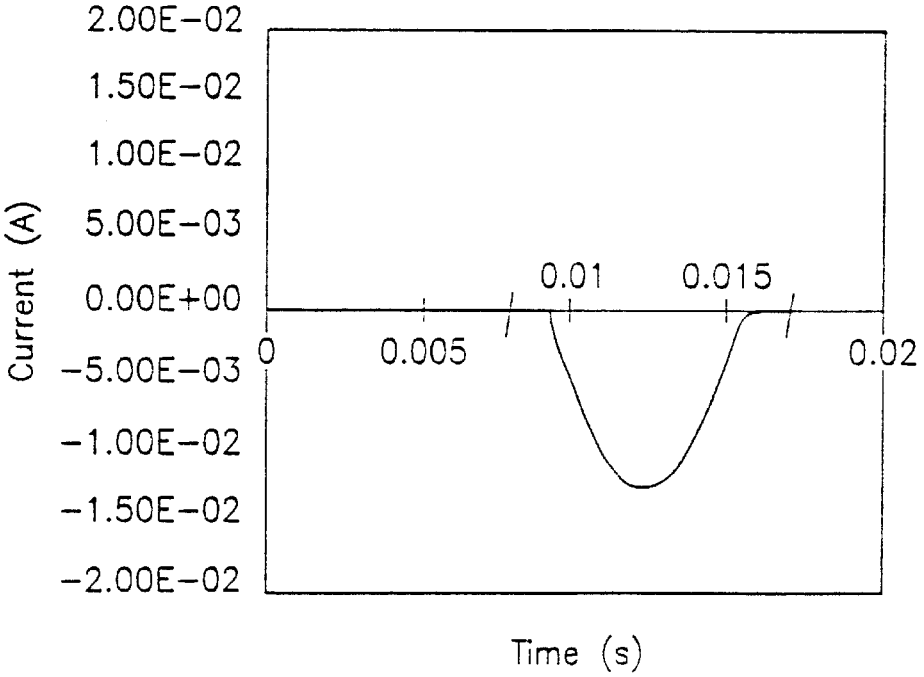
FIGS. 4A, 4B, 4C, 4D and 4E are plots of the outputs of the signal generator of FIG. 3.

The waveforms produced when switches 102A, 102B and 102C are actuated are the same as those shown in FIGS. 2A, 2B and 2C respectively. The waveform produced when switch 102A is actuated is a half sine wave only in the positive half cycle and the waveform produced when switch 102B is actuated is a half sine wave only in the negative half cycle. The waveform produced when switch 102C is actuated is a full sine wave. In the preferred embodiment of the present invention operating from a 60 Hz supply, a pulse 8.33 mSec in length during the positive half cycle can be produced when switch 102A is actuated and a pulse 8.33 mSec in length during the negative half cycle can be produced when switch 102B is actuated. Consecutive pulses 8.33 mSec in length can be produced when switch 102C is actuated. The microcomputer 210 needs to look at the incoming signal over several line cycles in order to properly determine which switch or switches have been actuated. Although the drawing figures only show one half cycle or a full cycle, it is understood that the signal generator 100 will repeatedly produce the signals 2A, 2B or 2C as long as the switch is actuated.

The waveforms produced when switches 102D, 102E, 102F, 102G and 102H are actuated are shown in FIGS. 4A, 4B, 4C, 4D, and 4E, respectively. The waveform produced when switch 102D is actuated is a half sine wave only in the negative half cycle delayed a time period after the zero crossing and ending a time period prior to the next zero crossing. See FIG. 4A. The waveform produced when switch 102E is actuated is a half sine wave only in the positive half cycle starting a delayed time period after the zero crossing and ending a time period prior to the next zero crossing. See FIG. 4B. The peak current as illustrated is approximately 12.5 mA.

Figure 4B:
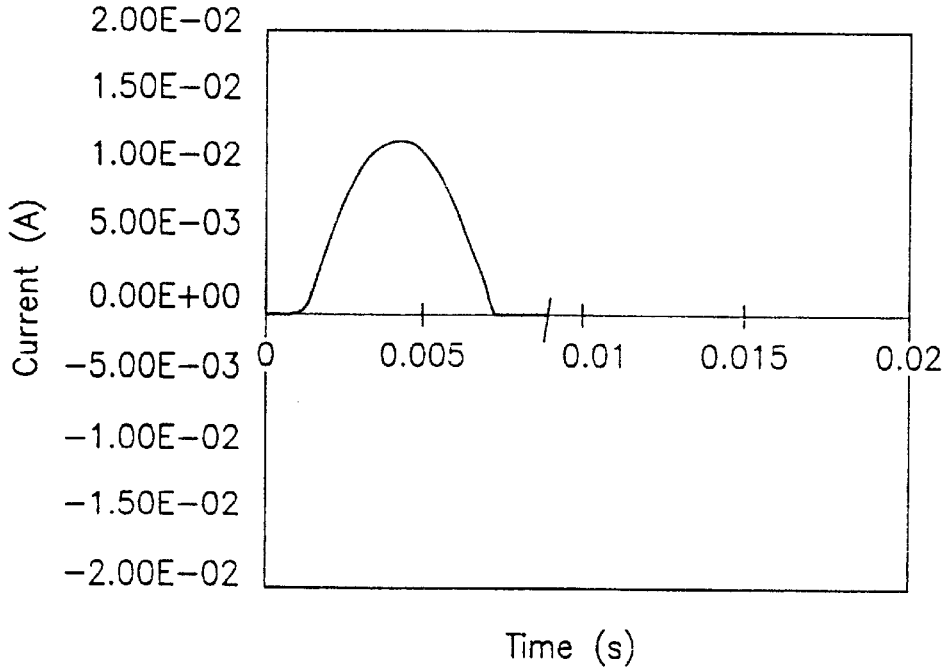
Figure 4C:
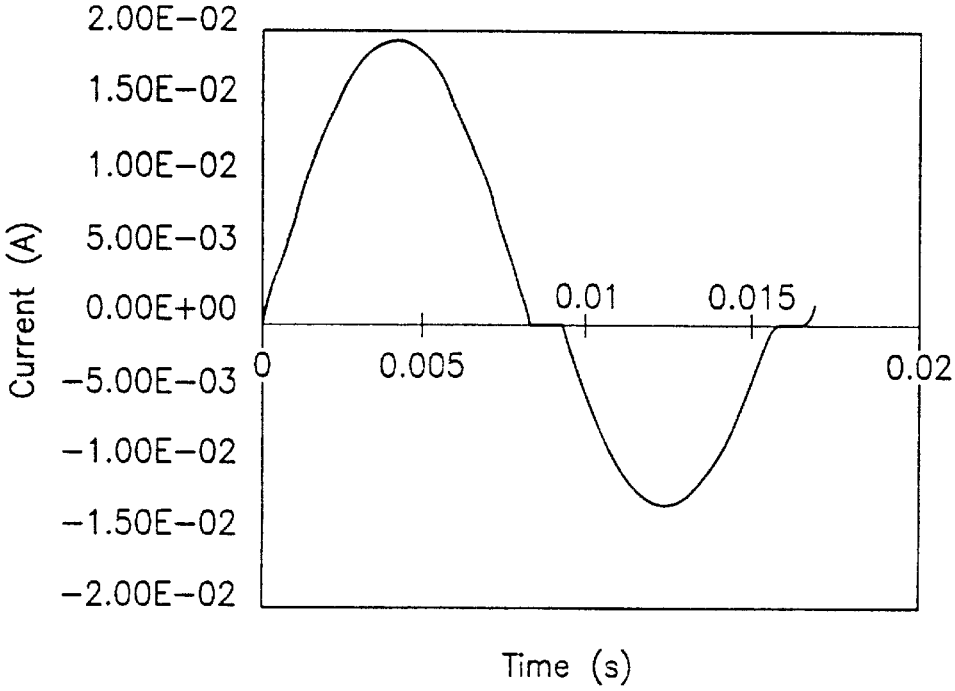

The waveform produced when switch 102F is actuated is a half sine wave in the positive half cycle followed by a half sine wave in the negative half cycle delayed a time period after the zero crossing and ending a time period prior to the next zero crossing See FIG. 4C. The peak current in the positive half cycle is approximately 20 mA and the peak current in the negative half cycle is approximately 12.5 mA.

The waveform produced when switch 102G is actuated is a half sine wave in the positive half cycle delayed a time period after the zero crossing and ending a time period prior to the next zero crossing followed by a half sine wave in the negative half cycle. See FIG. 4D.

The waveform produced when switch 102H is actuated is a half sine wave in the positive half cycle delayed a time period after the zero crossing and ending a time period prior to the next zero crossing followed by negative half cycle delayed a time period after the zero crossing and ending a time period prior to the next zero crossing. See FIG. 4E.

In the case of FIGS. 4A to 4E, each waveform has a region of substantially constant current, and in particular, a region of zero current before the zener diode switching device switches on at its break-over voltage. Further, like FIGS. 2A to 2C, the waveform shown or a portion thereof is repeated as long as the switch is actuated.

Figure 5:
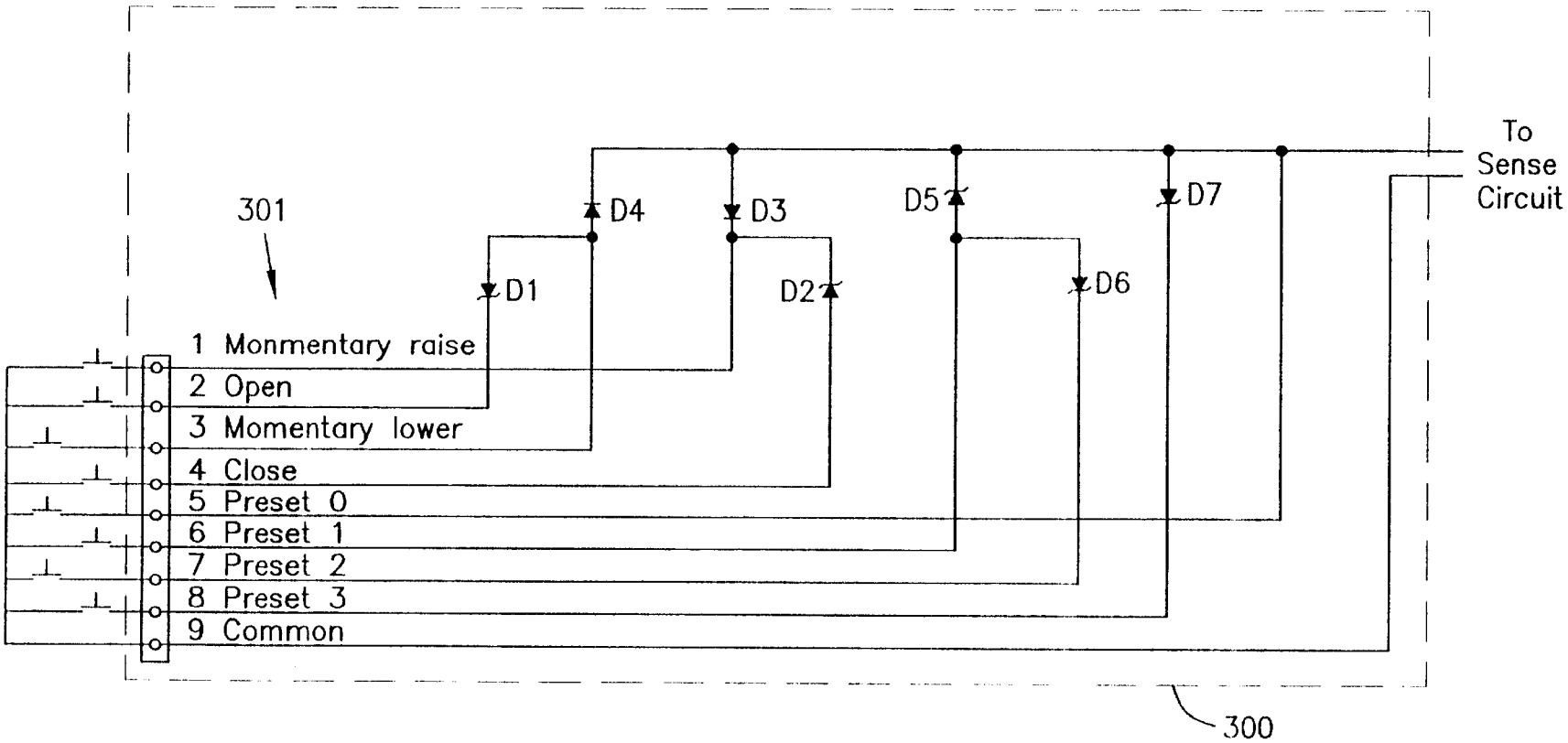
FIG. 5 is a simplified schematic diagram of a second embodiment of a signal generator according to the present invention.

FIG. 5 shows a simplified schematic diagram of another low cost signal generator 300. The signal generator 300 operates in a similar fashion to the signal generator shown in FIG. 3. The difference is that the signal generator 300 does not have any switches. The signal generator receives switch closures or control signals from an external source as shown at 301. The external source may be a plurality of remotely located switches or may be another controller sending control signals. For example, a fire detector or burglar alarm system could send a signal to the signal generator 300 to control a device. As an example, in the case of a fire, all motorized window shades could be raised.

Figure 6A:
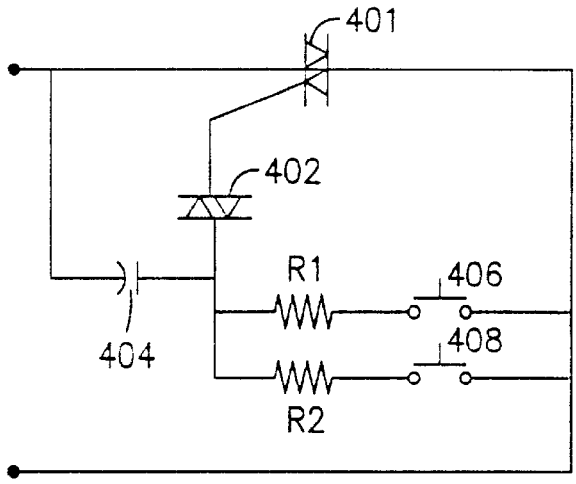
FIGS. 6A, 6B, 6C, 6D and 6E show further embodiments of signal generators according to the present invention.

FIGS. 6A–6E show further embodiments of signal generator circuits according to the present invention. These circuits use semiconductor switching devices having control electrodes controlled by a trigger circuit. FIG. 6A shows a signal generator circuit employing a triac 401 and a trigger circuit comprising diac 402, a capacitor 404 and resistors R1 and R2 each coupled to a momentary contact switch 406 and 408, respectively. In this circuit, triac 401 is fired at a given phase in the AC waveform to provide unique current waveforms. Changing of the values R1 and R2 varies the time at which triac 401 is latched on. Capacitor 404 and resistors R1 and R2 form time constant circuits. When either of momentary switches 406 or 408 are activated, the voltage at the junction of capacitor 404 and the resistors increases gradually according to the time constant determined by the resistance R1 or R2 and capacitance of capacitor 404. Once the voltage reaches a value sufficient to trigger diac 402, the diac conducts causing the triac 401 to conduct. Because the triac is bidirectional, the triac will conduct both for positive and negative half cycles. The waveforms generated by this circuit when switches 406 or 408 are actuated are shown in FIG. 7A for two different resistance values as illustrated in FIG. 7A(*a*) and FIG. 7A(*b*). The onset of conduction depends upon the value of the resistance. In contrast to the circuit of FIG. 3, the circuit of FIG. 6A produces a waveform having steep rising edges at the time the triac begins to conduct. Both however have a region where the current is substantially constant.

Figure 6B:
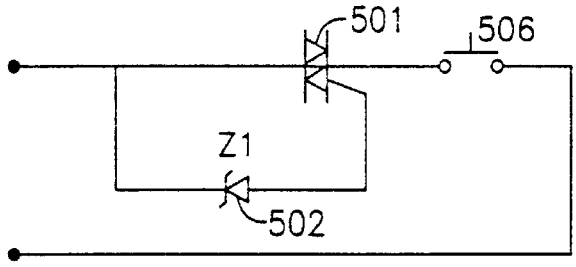
Figure 7A:
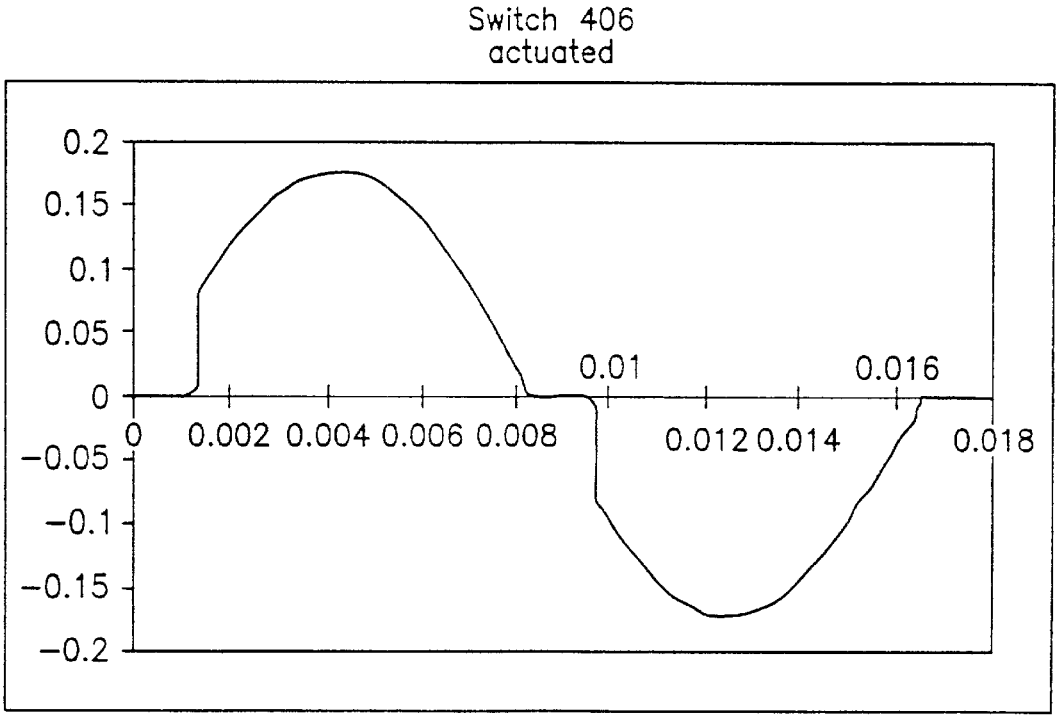
FIGS. 7A, 7B, 7C, 7D and 7E show waveforms of the circuits of FIGS. 6A, 6B, 6C, 6D and 6E, respectively.
Figure 7A:
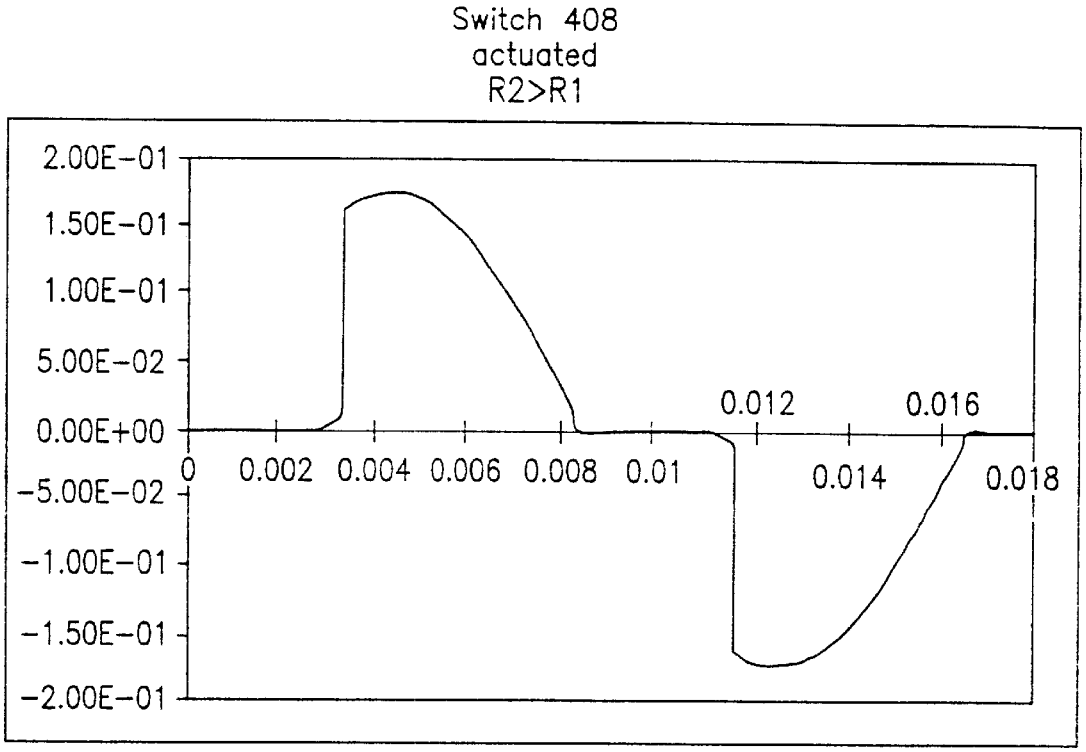
Figure 7B:
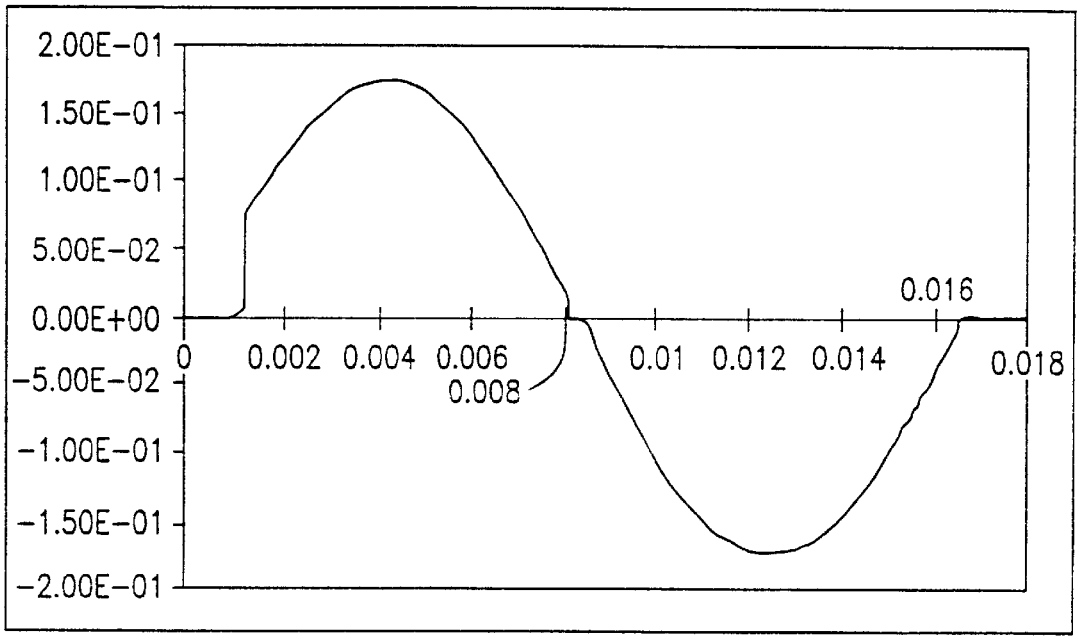

FIG. 6B shows another portion of a signal generator circuit according to the invention. In this signal generator circuit, a zener diode 502 triggers a triac 501 when a momentary contact switch 506 is actuated and a signal is generated. The waveform for the circuit of FIG. 6B is shown in FIG. 7B. Once the zener break-over voltage is reached, the triac 501 conducts. The waveform of FIG. 7B shows that there is a sharp rising edge for the positive half cycle which occurs when the zener break-over voltage is reached. During the negative half cycle, zener diode conducts like a conventional diode, so triac 501 is turned on for the entire negative half cycle. The triac turn-on time can be changed and accordingly, the location of the steep rising edge of the waveform of FIG. 7B changed, thus producing different control signals, by changing the zener diode used, i.e., using a zener diode having a different break-over voltage.

Figure 6C:
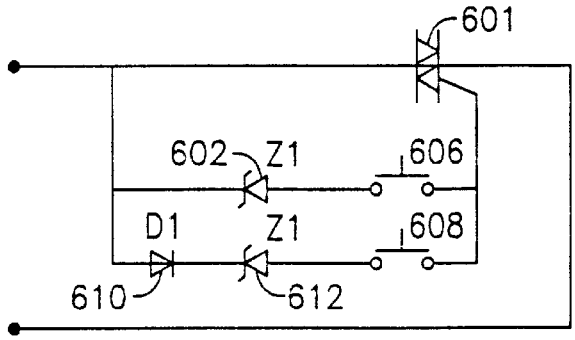
Figure 7C:
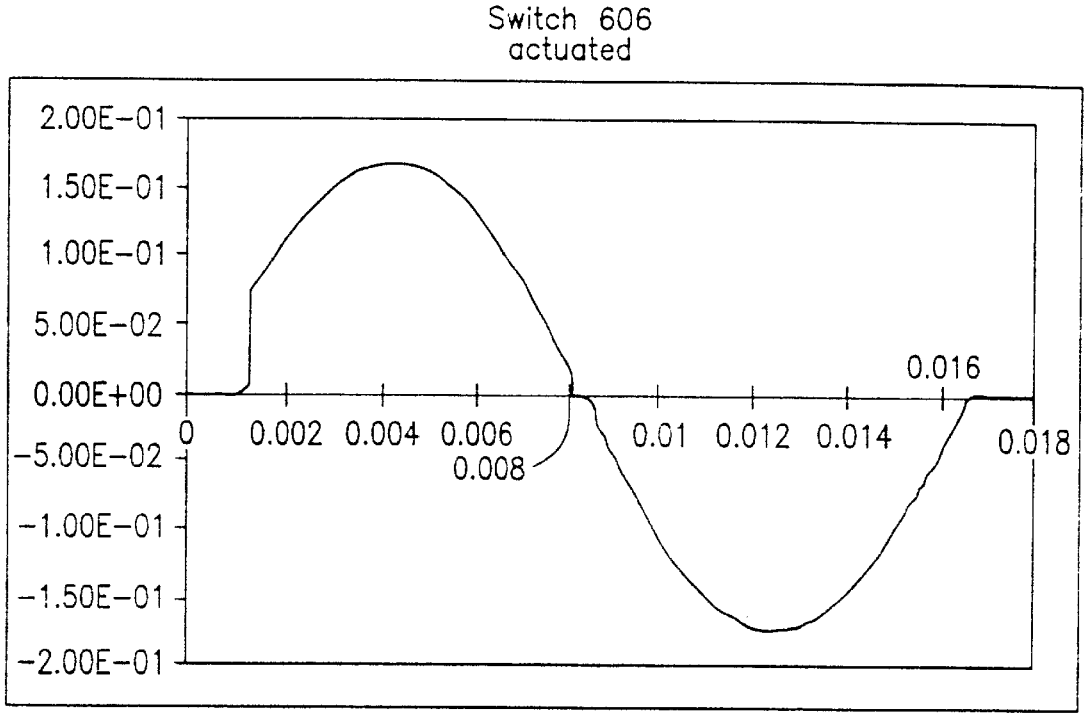
Figure 7C:
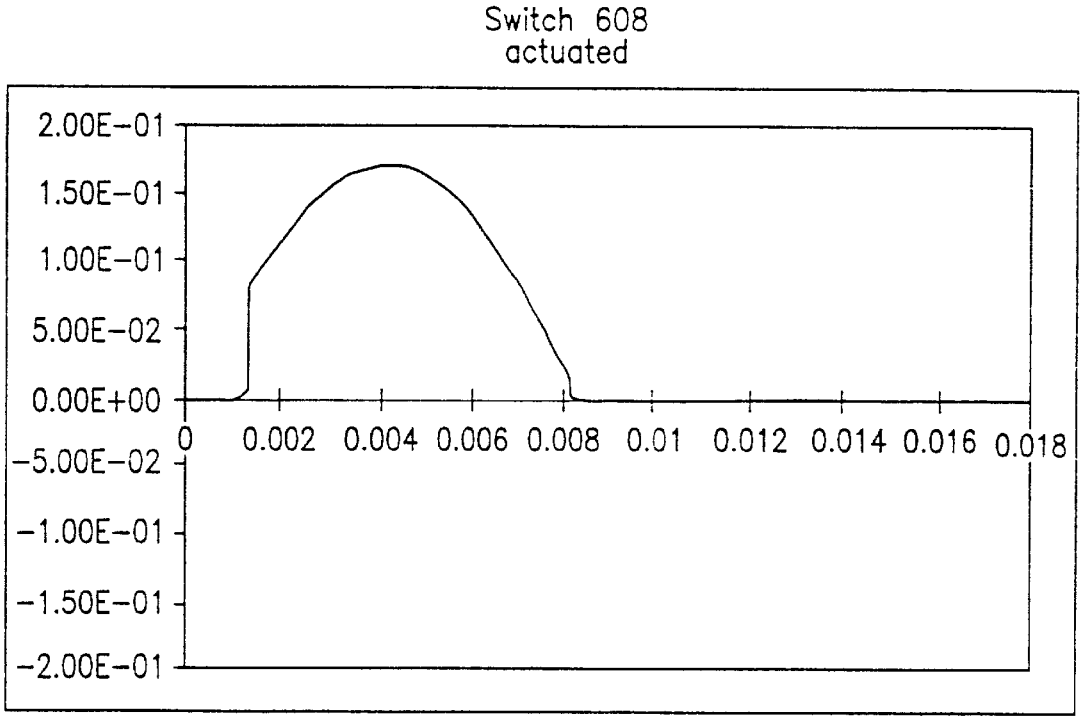

FIG. 6C shows another embodiment using a triac 601 and a number of diodes and zener diodes. A zener diode 602 and a momentary contact 606 are connected in series to the gate of the triac 601. Further connected to the gate of the triac 601 is a diode 610 and further zener diode 612 and a momentary contact 608 in series. The actuation of the switch 606 generates the signal of FIG. 7C(*a*). The time when the triac turns on can be delayed by using zener diodes having varying break-over voltage.

When the switch 608 is actuated, only the positive half cycle with a steep rising edge is produced because the diode 610 prevents any current flow when the negative half cycle of the AC waveform is present. See FIG. 7C(*b*).

Figure 6D:
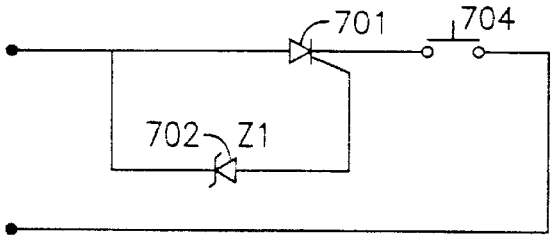
Figure 7D:
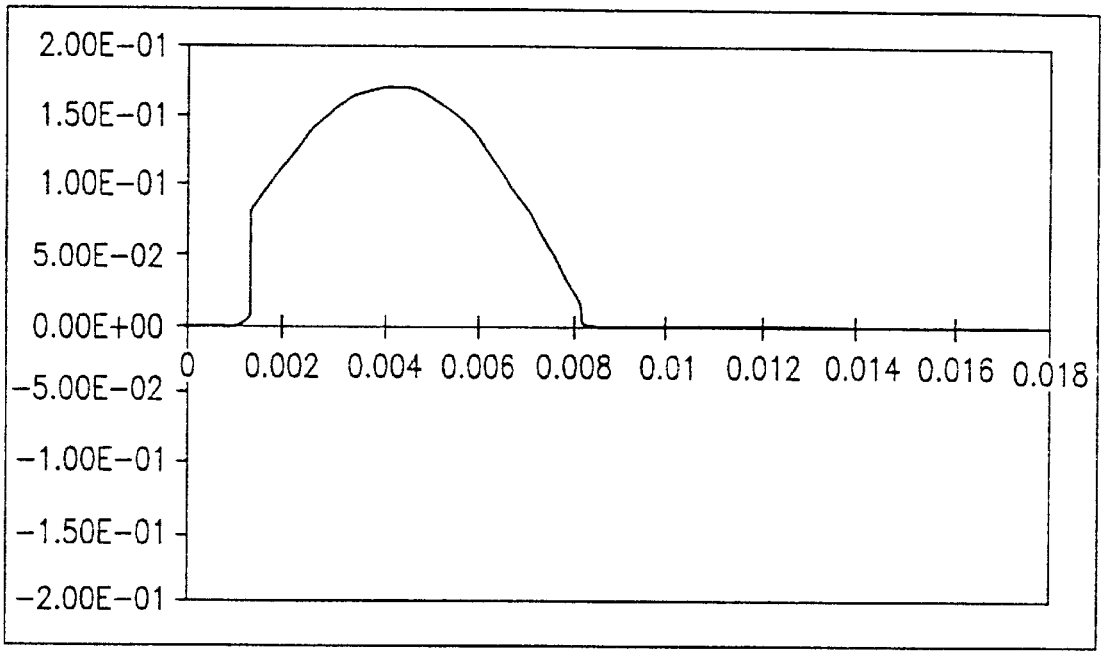

FIG. 6D shows the use of a zener diode in a signal generating circuit to turn on an SCR. The circuit comprises an SCR 701 and a zener diode 702. A momentary contact 704 is provided. When the momentary contact 704 is actuated, the SCR is triggered once the break over voltage of the zener diode 702 is exceeded during the positive half cycle. FIG. 7D shows the waveform generated by the signal generating circuit of FIG. 6D. In contrast to the triac circuit, because the SCR is unidirectional, only the positive half cycle is generated. To generate the negative half cycle, the conductive direction of the SCR 701 would be reversed and the zener diode would be polarized oppositely to that shown in FIG. 6D.

Figure 6E:
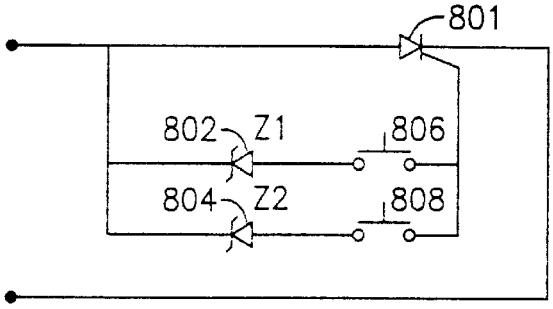
Figure 7E:
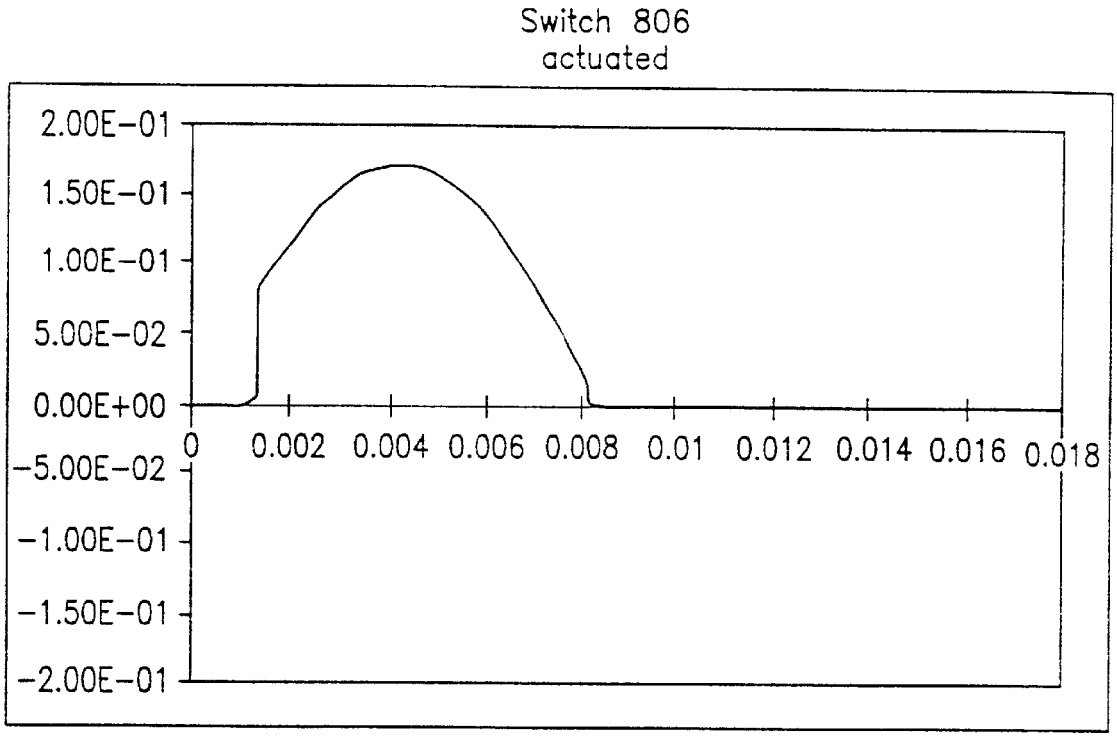
Figure 7E:
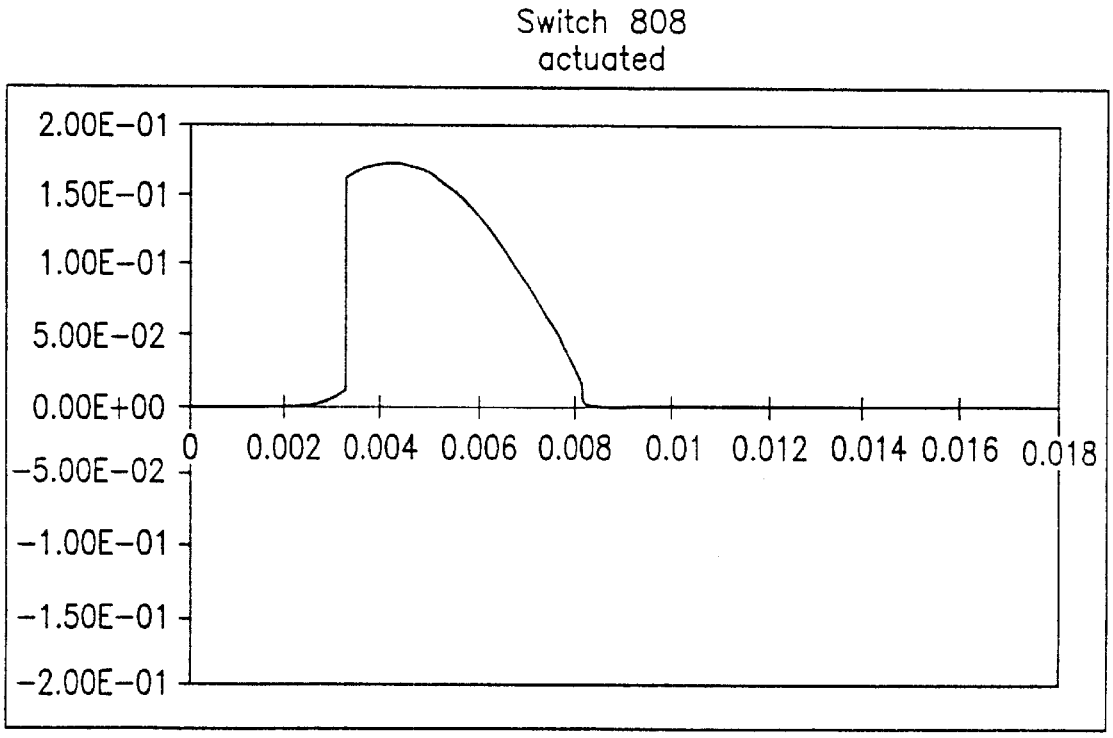

FIG. 6E shows another signal generating circuit according to the invention utilizing SCR 801 two zener diodes 802 and 804, and momentary contacts 806 and 808. The zener diodes 802 and 804 have break-over voltages of V and 2V, respectively. Accordingly, the SCR 801 conducts when the momentary switches 806 or 808 are actuated at times determined by the break-over voltage of the zener diodes. The waveforms generated are shown in FIGS. 7E(*a*) and (*b*). The waveform caused by actuation of switch 808 would have a delayed rising edge as compared to the waveform for the switch 806. In order to generate a signal during the negative half cycle, the zener diodes and SCR would be polarized oppositely.

Zener diodes 502, 602, 604, 702, 802 and 804 can alternatively be replaced with suitable value diacs in order to practice the present invention.

Figure 8A:
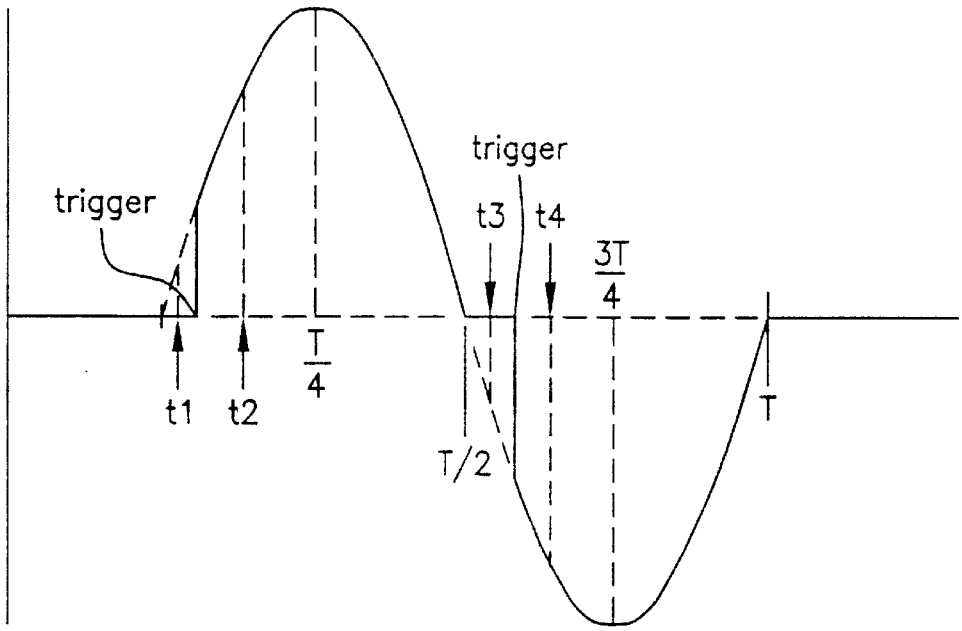
FIGS. 8A and 8B show how the control unit decodes the control signals produced by the signal generator for two examples.
Figure 8B:
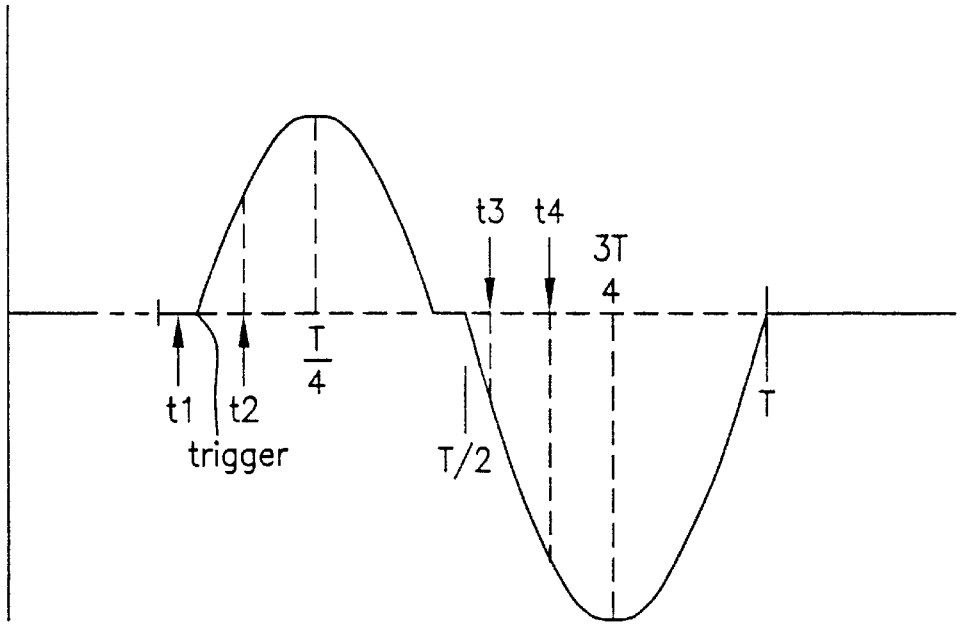
Figure 3:
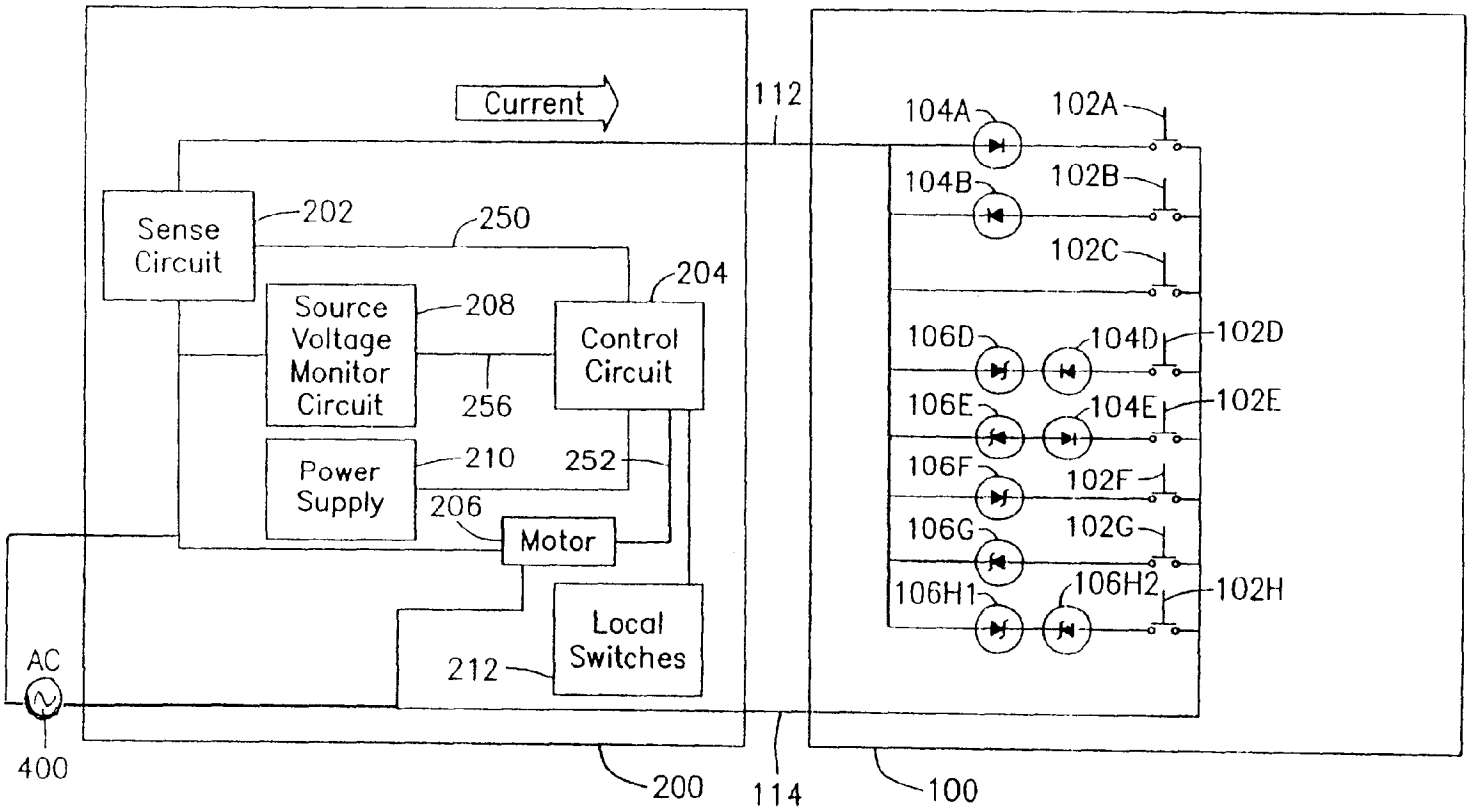

FIGS. 8A and 8B show examples of operation of the sensing circuit 202 under control of the control circuit 204 and source voltage monitor circuit 208. FIG. 8A shows an example of a control signal from the signal generating circuit of FIG. 6A. The waveform shown has a period T. This circuit produces a control signal which has a steep rising edge once the triac 401 conducts. As discussed, the sensing circuit 202 can be controlled by the control circuit 204 to sense or sample the current or voltage in the line 112, once prior to triggering of the triac 401, at a time t1 and once after triggering of the triac at a time t2 in each half cycle. The timing may be controlled to be at predefined times after the zero crossings. Accordingly, at a time prior to triggering of the triac, the sensing circuit would sense that there is no voltage or current on line 112. After the triac triggers at a time t2, the sensing circuit 202 would sense a voltage or current present on line 112. Similarly, at time t3 and t4, the sensing circuit 202 would sense no signal present at t3 and a negative signal present at t4. The sensing circuit would thus be able to detect the presence of the unique signal provided by the signal generating circuit of FIG. 6A. If the signal generating circuit of 6A were used in conjunction with the other signal generating circuits of FIGS. 6B, 6C, 6D, 6E or those of FIG. 3, in each case, the signal sensing circuit 202 would detect a unique signal which could be used to control a particular function.

Figure 4D:
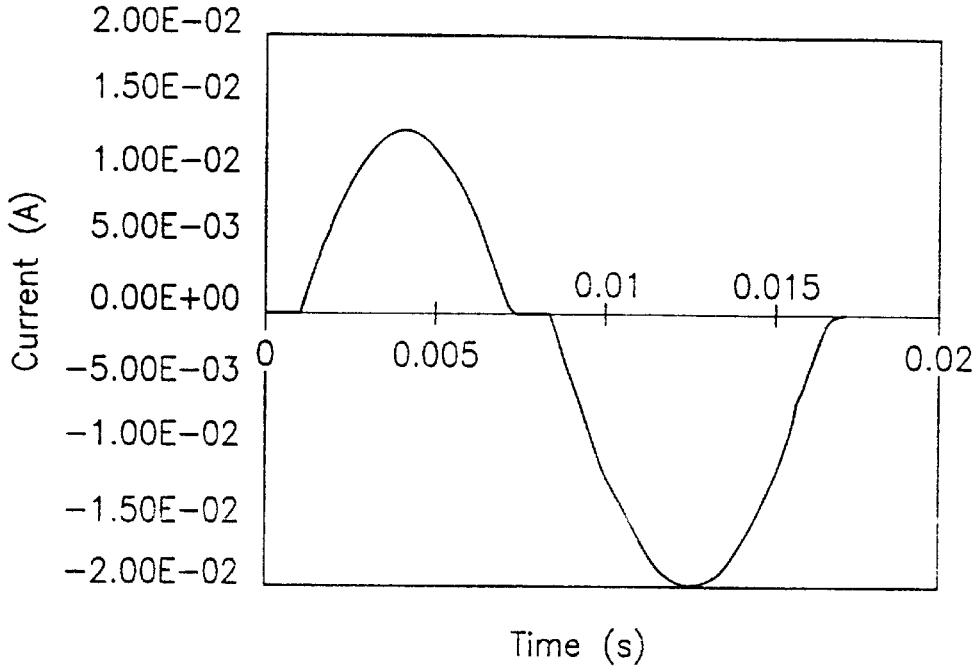
Figure 4E:
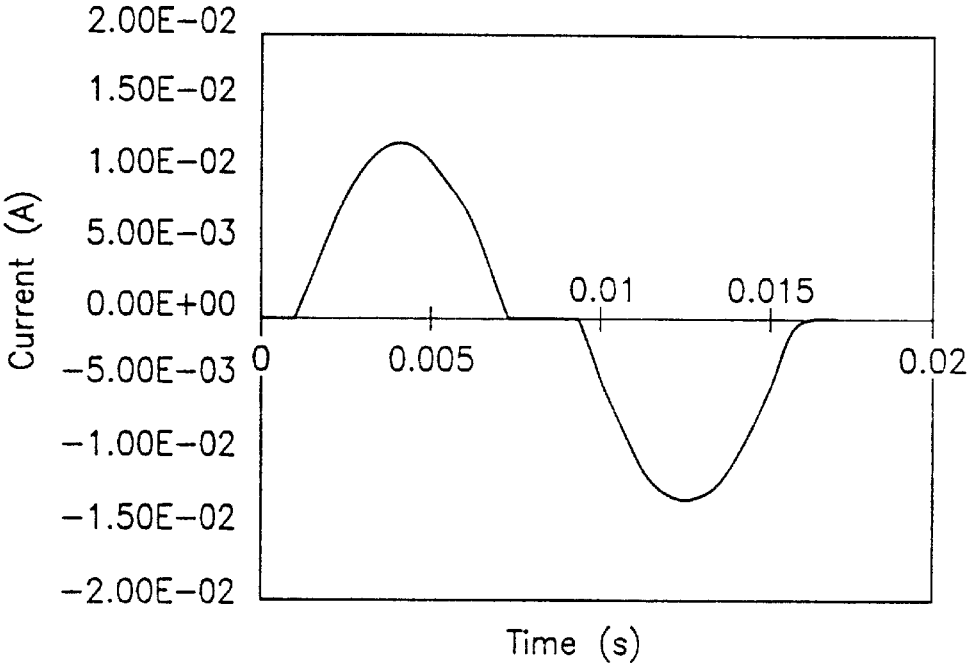

Turning to FIG. 8B, for example, which shows the control signal like the signal of FIG. 4D generated by actuation of a switch 102G coupled in series with a zener diode 106G of FIG. 3. At a time t1, before zener diode 106G has triggered, no signal would be sensed. At a time t2, after zener diode 106G has triggered, a signal would be sensed. At times t3 and t4, a negative signal would be sensed since the zener diode 106G would be conducting for the negative half cycle. Accordingly, the unique signal provided by a control circuit having a zener diode 106G and a momentary contact 102G coupled in series as shown in FIG. 3 could be uniquely determined by the sensing circuit 202 and utilized by the control circuit 204 to control a specified function.

The source voltage monitor circuit 208 is used to inform the control circuit 204 of the appropriate times for sampling, i.e., the source voltage monitor circuit 208 can determine the zero crossings thus allowing the control circuit 204 to implement the samples at the times t1, t2, t3 and t4, as shown.

Similarly, for each of the unique control signals shown in FIGS. 7A–7E as well as 2A–2C and 4A–4E, the sensing circuit 202 is able to uniquely determine the presence of the uniquely coded signal and thus control the appropriate function as controlled by that control signal.

As fully described above, the present invention provides a novel circuit that can produce a plurality of control signal over only two wires and a circuit that can decode these control signals. The present invention may be embodied in other specific forms without departing from the spirit or essential attributes thereof, and accordingly, reference should be made to the appended claims, rather than to the foregoing specification, as indicating the scope of the invention.

What is claimed is:

1. A signal generator comprising:

a plurality of switches adapted to be coupled to an alternating current source, the source having an alternating current source signal waveform;

each switch in series with a voltage threshold triggered switch device comprising at least one of a zener diode, diac, triac and silicon controlled rectifier;

the signal generator producing an output when one of the plurality of switches is actuated, the output representing a uniquely coded signal dependent on which of the plurality of switches is actuated, the output comprising a selected portion of the alternating current source signal waveform for a cycle of the alternating current source signal waveform;

wherein the output comprises at least one of:

a half cycle of the output having zero crossings spaced closer together than the alternating current source signal waveform;

two half cycles of the output with one half cycle having zero crossings spaced closer together than the alternating current source signal waveform; and two half cycles of the output wherein both half cycles have zero crossings spaced closer together than the alternating current source signal waveform.

2. A signal encoding and detector circuit comprising:

a signal encoding circuit adapted to be coupled to an AC source having an AC source waveform, the signal encoding circuit encoding a cycle of the AC source waveform as an encoded signal by providing at least one of:

at least one half cycle of the encoded signal having zero crossings spaced closer together than the AC source waveform;

two half cycles of the encoded signal with one half cycle having zero crossings spaced closer together than the AC source waveform;

two half cycles of the encoded signal wherein both half cycles have zero crossings spaced closer together than the AC source waveform; and at least one half cycle of the encoded signal having a delayed turn-on portion whereby the delayed turn-on portion comprises an edge turn-on portion; further comprising:

a sense circuit, a control circuit coupled to the sense circuit, the control circuit producing a selected control signal when the sense circuit receives said encoded signal.

3. The signal encoding and detector circuit of claim 2, wherein the control circuit obtains samples from the sense circuit at a plurality of predefined times in each half cycle of the encoded signal in order to determine a shape of the AC signal.

4. The signal encoding and detector circuit of claim 2, wherein the sense circuit senses a duration and polarity of said encoded signal.

5. A signal generator comprising:

a plurality of switches adapted to be coupled to an alternating current source, the source having an alternating current source signal waveform;

each switch in series with a voltage threshold triggered switch device comprising at least one of a zener diode, diac, triac and silicon controlled rectifier;

the signal generator producing an output when one of the plurality of switches is actuated, the output representing a uniquely coded signal dependent on which of the plurality of switches is actuated, the output comprising a selected portion of the alternating current source signal waveform for a cycle of the alternating current source signal waveform.

6. The signal generator of claim 5, wherein the signal generator comprises two and only two conductors for connection to a sense circuit, the sense circuit coupled to the AC source.

7. The signal generator of claim 5, wherein at least one switch comprises a tactile switch.

8. The signal generator of claim 5, wherein at least one switch comprises a semiconductor switch.

9. The signal generator of claim 5, wherein at least one switch comprises a momentary contact switch.

10. The signal generator of claim 5, wherein the output has a region having a substantially constant current, the substantially constant current being approximately a zero current.

11. The signal generator of claim 5, wherein the voltage threshold triggered switch device comprises a Zener diode.

12. The signal generator of claim 5, wherein the output comprises at least a portion of one half cycle of the alternating current source signal waveform, the portion having a delayed turn-on caused by said voltage threshold triggered switch device, whereby the delayed turn-on comprises an edge turn-on portion.

13. The signal generator of claim 12 wherein the voltage threshold triggered switch device comprises one of a Zener diode, diac, triac and silicon controlled rectifier.

14. A signal generating circuit comprising:

a plurality of first switch devices adapted to be coupled to an AC supply, the AC supply having an AC supply waveform:

at least one triggered switch device coupled to at least one of the first switch devices, the at least one triggered switch device comprising at least one of a zener diode, a diac, a triac and a silicon controlled rectifier;

operation of at least one of the first switch devices causing said triggered switch device to trigger in response to the AC supply at a predetermined voltage, thereby providing at least a portion of a waveform of the AC supply as a control signal and wherein the control signal terminates within a predetermined period of time after operation of the first switch device terminates, and further wherein each of the plurality of switches provides a unique control signal comprising at least a half cycle of the AC supply waveform that is different from the control signal provided by each other of said plurality of switches.

15. The signal generating circuit of claim 14, wherein the predetermined period of time is one ine cycle of the AC supply.

16. The signal generating circuit of claim 14, wherein the triggered switch device comprises a Zener diode.

17. The signal generating circuit of claim 16, wherein the Zener diode is coupled in series with at least one of the first switch devices.

18. The signal generating circuit of claim 16 further comprising a diode coupled in series with the Zener diode and at least one of the first switch devices.

19. The signal generating circuit of claim 16, further comprising a further Zener diode, the further Zener diode being polarized opposite the Zener diode.

20. The signal generating circuit of claim 14, wherein the triggered switch device comprises a semiconductor switch having a control electrode, the control electrode being coupled to a trigger circuit.

21. The signal generating circuit of claim 20, wherein the trigger circuit comprises Zener diode.

22. The signal generating circuit of claim 20, wherein at least one of the first switch devices is coupled in series with the semiconductor switch.

23. The signal generating circuit of claim 20 wherein the semiconductor switch comprises a silicon controlled rectifier.

24. The signal generating circuit of claim 20, wherein at least one of the first switch devices is coupled in series with the trigger circuit.

25. The signal generating circuit of claim 24, wherein the trigger circuit comprises a Zener diode.

26. The signal generating circuit of claim 20, wherein the trigger circuit comprises a time constant circuit coupled in series with at least one of the first switch devices.

27. The signal generating circuit of claim 26, wherein the time constant circuit is coupled to the control electrode to trigger the semiconductor switch.

28. The signal generating circuit of claim 27, wherein the semiconductor switch comprises a triac.

29. The signal generating circuit of claim 28 further comprising a diac coupled between the time constant circuit and the control electrode.

30. A method for encoding a signal comprising the steps of:

coupling an AC waveform to a signal generator circuit;

encoding with the signal generator circuit the AC waveform as an encoded signal by operating one of a plurality of switches wherein each switch provides a unique portion of a cycle of the AC waveform as the encoded signal, and the number of the unique portions includes the following:

a) a half cycle of the AC waveform;

b) a portion of a half cycle of the AC waveform, the unique portion having zero crossings that are spaced closer together than zero crossings of the AC waveform and;

c) a half cycle of the AC waveform having a delayed turn-on.

31. The method of claim 30, wherein the unique portion has a pulse duration and a polarity and further comprising the step of decoding the encoded signal by sensing the duration and the polarity of the unique portion.

* * * * *

UNITED STATES PATENT AND TRADEMARK OFFICE

CERTIFICATE OF CORRECTION

PATENT NO. : 6,346,781 B1 
DATED : February 12, 2002
INVENTOR(S) : Donald R. Mosebrook et al.

It is certified that error appears in the above-identified patent and that said Letters Patent is hereby corrected as shown below:

The title page showing the illustrative figure should be replaced with the attached page.

In the drawings, Sheet 4 of 14, consisting of Figure 3, should be replaced with the corrected Figure 3, as shown on the attached page.

Signed and Sealed this

Seventeenth Day of August, 2004

JON W. DUDAS
*Acting Director of the United States Patent and Trademark Office*

(12) United States Patent
Mosebrook et al.

(10) Patent No.: US 6,346,781 B1
(45) Date of Patent: Feb. 12, 2002

(54) SIGNAL GENERATOR AND CONTROL UNIT FOR SENSING SIGNALS OF SIGNAL GENERATOR

(75) Inventors: Donald R. Mosebrook, Coopersburg; Lawrence R. Carmen, Jr., Hellertown, both of PA (US)

(73) Assignee: Lutron Electronics Co., Inc., PA (US)

( * ) Notice: Subject to any disclaimer, the term of this patent is extended or adjusted under 35 U.S.C. 154(b) by 0 days.

(21) Appl. No.: 09/873,749

(22) Filed: Jun. 4, 2001

Related U.S. Application Data

(62) Division of application No. 09/400,928, filed on Sep. 22, 1999.

(51) Int. Cl.[7] ..... G05F 1/00

(52) U.S. Cl. ..... 315/294; 315/292; 315/297; 315/291; 315/320

(58) Field of Search ..... 315/294, 297, 315/292, 320, 291, 307, 322, 315, 149, DIG. 4

(56) References Cited

U.S. PATENT DOCUMENTS

| | | | | |
|---|---|---|---|---|
| 4,489,263 | A | 12/1984 | Potter et al. | 318/727 |
| 4,714,862 | A | 12/1987 | Dannert et al. | 315/244 |
| 4,721,953 | A | 1/1988 | dePauw | 340/825.17 |
| 4,746,809 | A | 5/1988 | Coleman et al. | 307/1 |
| 4,751,433 | A | 6/1988 | Baccanelli | 315/158 |
| RE33,504 | E | 12/1990 | Yuhasz et al. | 307/45 |
| 5,017,837 | A | 5/1991 | Hanna et al. | 315/136 |
| 5,144,205 | A | 9/1992 | Motto et al. | 315/244 |
| 5,248,919 | A | 9/1993 | Hanna et al. | 315/291 |
| 5,519,263 | A | 5/1996 | Santana, Jr. | 307/115 |
| 5,541,584 | A | 7/1996 | Mehta et al. | 340/825.57 |
| 5,619,081 | A | 4/1997 | Gershen et al. | 307/125 |
| 5,731,664 | A | 3/1998 | Posa | 315/194 |
| 5,798,581 | A | 8/1998 | Keagy et al. | 307/118 |
| 5,861,720 | A | 1/1999 | Johnson | 315/291 |
| 6,169,377 | B1 * | 1/2001 | Bryde et al. | 315/294 |

FOREIGN PATENT DOCUMENTS

| | | |
|---|---|---|
| EP | 0786850 | 7/1997 |

* cited by examiner

*Primary Examiner*—Don Wong
*Assistant Examiner*—Tuyet T. Vo
(74) *Attorney, Agent, or Firm*—Ostrolenk, Faber, Gerb & Soffen, LLP

(57) ABSTRACT

A signal generating circuit coupled to an AC supply, the circuit comprising at least one first switch device coupled to the AC supply, at least one triggerable switch device coupled to the first switch device, operation of the first switch device causing said triggerable switch device to trigger in response to the AC supply at a predetermined voltage, thereby providing at least a portion of a waveform of the AC supply as a control signal and wherein the control signal terminates within a predetermined period of time after operation of the first switch device terminates. A circuit for detecting and responding to the signals generated by the signal generator is also disclosed.

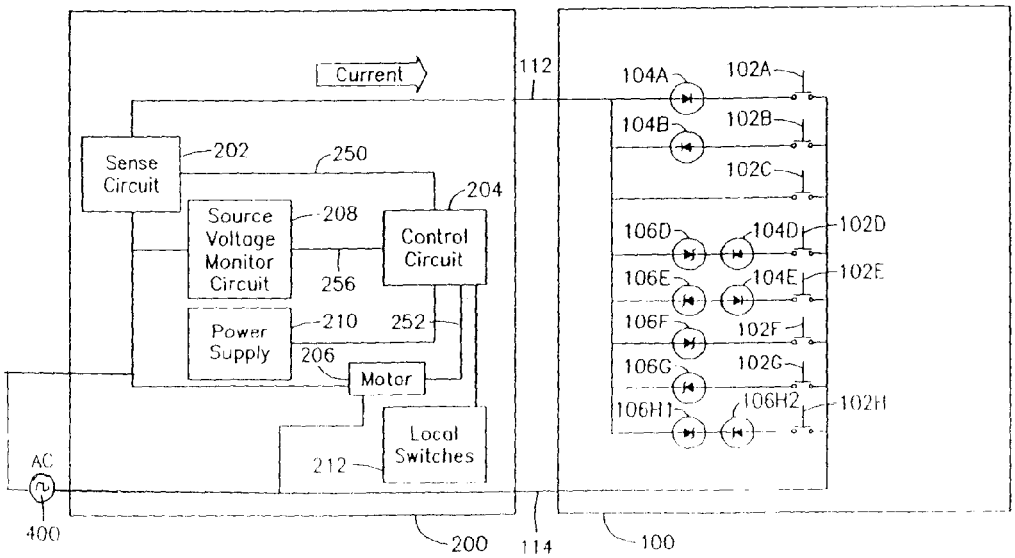

31 Claims, 14 Drawing Sheets